US010960293B1

(12) United States Patent
Cappetta

(10) Patent No.: US 10,960,293 B1
(45) Date of Patent: Mar. 30, 2021

(54) AIR ASSISTED ROLL DOWN GAME

(71) Applicant: Louis J. Cappetta, Toms River, NJ (US)

(72) Inventor: Louis J. Cappetta, Toms River, NJ (US)

( * ) Notice: Subject to any disclaimer, the term of this patent is extended or adjusted under 35 U.S.C. 154(b) by 0 days.

(21) Appl. No.: 16/455,701

(22) Filed: Jun. 27, 2019

Related U.S. Application Data

(60) Provisional application No. 62/792,945, filed on Jan. 16, 2019.

(51) Int. Cl.

| | |
|---|---|
| ***A63F 7/07*** | (2006.01) |
| ***A63F 7/00*** | (2006.01) |
| ***A63F 7/06*** | (2006.01) |
| ***A63F 7/30*** | (2006.01) |

(52) U.S. Cl.
CPC ..... *A63F 7/0005* (2013.01); *A63F 7/0058* (2013.01); *A63F 7/066* (2013.01); *A63F 7/3065* (2013.01); *A63F 2007/0011* (2013.01)

(58) Field of Classification Search
CPC ..... A63F 7/0005; A63F 7/0058; A63F 7/066; A63F 7/3065; A63F 2007/0011
USPC ..... 273/108, 108.57, 118 A, 118 R, 119 B, 273/129 AP
See application file for complete search history.

(56) References Cited

U.S. PATENT DOCUMENTS

| | | | | | |
|---|---|---|---|---|---|
| 2,267,567 | A * | 12/1941 | Johnson | A63F 7/066 | 273/119 B |
| 2,270,566 | A * | 1/1942 | Vinton | A63F 7/066 | 273/119 B |
| 3,038,725 | A * | 6/1962 | Stewart | A63F 7/066 | 273/119 B |
| 3,260,527 | A * | 7/1966 | Younce | A63B 63/00 | 473/166 |
| 3,438,632 | A * | 4/1969 | Rosenvold | A63F 7/0005 | 273/118 R |
| 3,771,789 | A * | 11/1973 | Kammerl | A63F 7/066 | 273/108.57 |
| 4,834,384 | A * | 5/1989 | Cortesi | A63D 15/00 | 273/118 R |
| 5,288,071 | A * | 2/1994 | Solomon | A63F 9/0079 | 273/129 AP |
| 5,772,535 | A * | 6/1998 | Murphy | A63B 5/11 | 273/349 |
| 2004/0224793 | A1* | 11/2004 | Wengert | A63B 69/36 | 473/409 |

* cited by examiner

*Primary Examiner* — Vishu K Mendiratta
(74) *Attorney, Agent, or Firm* — Andrew C. Aitken

(57) ABSTRACT

An arcade game comprising an elevated ally having a first flat planar section to receive rolling game elements and a second alley section having a plurality of targets, wherein the targets are passages though the second alley section and sized to allow the rolling elements to pass through said passages and game has a compressed gas reservoir and a plurality of exit portals and a controller that allows players to release gas and affect the motion of rolling elements on the target section.

10 Claims, 4 Drawing Sheets

AIR ASSISTED ROLL DOWN GAME

Applicant claims the benefit of the filing date of U.S. Application No. 62/792,945 filed on Jan. 16, 2019.

BACKGROUND OF THE INVENTION

Roll down games have been provided at arcades for many years. The games are appealing to all ages and game play involves elements of both luck and skill. In many conventional embodiments multiple machines are attached together to allow for multi-player competition. As soon as a first player meets the object of the game, the play at linked games is stopped and an award is distributed to the winning player.

A conventional Fascination table of the prior art is about 1.3 meters long, 50 centimeters wide and 1 meter high. Typically, a number of tables are arranged next to one another and the games are configured to allow for competitive play among multiple tables.

The players are each positioned at a first end of the table. At the other end of the table is a series of 25 holes, roughly 5 cm in diameter, arranged in a five-by-five square matrix or grid. The player rolls a ball, which may be similar to a racquetball or handball, toward the holes. The ball that is used is only slightly smaller than the target holes. As the ball falls through one of the holes, it is detected and a light on a backboard display corresponding to the target hole lights up. The player can see the pattern corresponding to the holes that the balls have fallen through and which targets are required to complete the objective of hitting five targets in a row. The ball then rolls back to the player on a ramp having a slight incline slanted back from the holes to the player location at the front of the device. The process is repeated until a player lights five lights in a row, either across the matrix, in a vertical column, or on a diagonal, similar to the game of Bingo. In some embodiments, like Bingo, the hole in the center of the matrix is a "free space." A glass plate over the front part of the table keeps players from reaching too far over the table to improve their aim.

Fascination tables are typically installed in groups from 20 to 50, but can be in as small a system of 2, up to any amount without limit, and are interlocked through an electromechanical or electronic system. Players compete against one another, with the first player to complete a row of five being the winner. An interlocking system determining which was first to compete the five ball in arrow and will locking out all others. If two or more players tie, each is declared a winner. Games usually last between 60 and 90 seconds, with a new game starting soon after the end of the previous one.

Winners may receive a tickets, tokens or credits which can be redeemed for prizes. In some embodiments, a bonus may be won by winning with all spots lighted on a certain row marked by colored lights in a display provided above the target field. For example, the top row on the board (the back row of holes) may be displayed in the grid display as "red" and if all the targets are successfully hit, may award a win three to five times the normal rate; A fourth row from the top (the second row of holes from the front) may be designed as "gold" and a successful player would be awarded at double the normal rate.

In some embodiments, an announcer may preside over the game play. The game play is initiated by pressing a button which provide an audible and visual signal and activates all of the linked machines. Balls are them released so they are accessible to the players. Play proceeds until a player achieves the object of the game, namely, rolls a ball through five holes in a line. When a win is detected, a second audible signal is transmitted and the announcer may broadcast the winner. A fee may be paid using a credit activation device or may be manually paid before play begins. The winner can redeem tickets, tokens or credits at a redemption center.

In another roll-down game, referred to as Pokerino, the target holes are associated with playing cards and the object of the game is to the highest five card poker hand. The hands are displayed on a scoreboard. Pokerino uses holes that are designated 9, 10, Jack, Queen, King and Ace and different suits in a 6 by 6 matrix.

A third prior art roll-down device is known as the Lite-a-Line game. The Lite-a-Line game can be characterized as a combination of pinball and bingo. The game is similar to pinball because a player uses a plunger device to put a ball into play and is like Bingo because the player must hit five targets in a row to win. As a ball drops through one of 25 holes on the board, a corresponding light on a grid on a five-by-five scoreboard provided at the rear of the game is illuminated. Like the Fascination game, an announcer will manage the collection fees and start the game. Like pinball machines, to put a ball into play, a player pulls back a plunger and releases it to propel the ball up an inclined board past a drop location. If the player doesn't release the ball with enough force, it won't reach the drop point on the board and will roll back down to the plunger. The player can then replay the ball. Balls that are released with too much force, will pass the drop point but may bounce off a surface and return back to the plunger. If the player releases the ball with the correct an amount of force, it will drop down the board toward the 25 target holes. In the Lite-a-Line game the holes are designed into five colors, with five holes per color and each colored set are numbered one to five. Like Fascination, as the ball passes through a hole, it will illuminate a corresponding light on a back display and score board. If the target has already been activated, the display board remained unchanged when the ball passes through. Certain targets may be pre-lit before the game begins. The first player to illuminate five targets in a row, either horizontally, vertically or diagonally, will result in a win and all of the linked games will be locked and play discontinued. Scoring may be provided for different events, for example, a bonus may be paid out for a win with no extraneous marks on the display. Other scoring techniques may allow for second and third place finishes wherein the play is not locked out until the last recognized finisher, or providing payouts to the first player to illuminate four targets in a row.

SUMMARY OF THE INVENTION

The present invention is directed to an improvement to arcade and redemption games wherein the user is provided with a controller that allows for the timed release of bursts of air from nozzles or exit ports from locations on or adjacent to a play field. This feature allows the user to affect the direction of game pieces that have been put into play.

In a first embodiment, the air nozzles or exit ports supplied at locations provided on roll-down games such as Fascination or Pokerino. Players can release bursts of air to affect the movement of balls in the field of play and therefore direct or influence the direction of balls toward intended targets. As used herein, the term "roll-down games" refers to games wherein a player rolls a ball or series of balls down a ramp or inclined surface towards an array of targets. The object of the game is to roll the balls into target holes. In embodiments, the object is to roll the balls to hit a predesignated number of targets in a line, which may be on an X axis, a Y axis or a diagonal line from the perspective of a player.

In an embodiment, the targets are in a target area that includes a series of openings in a five by five grid array. A sensor is provided in connection with each opening and the target area is substantially flat. Other target configurations are also contemplated. In other embodiments, the targets are arrayed in a single line at the end of the ramp.

While roll-down games have enjoyed widespread popularity in the past, the new features disclosed herein are intended to provide new life and interest to both existing games that may be retrofitted or new games that incorporate the new features.

In an embodiment of the invention, a switch or activation device is provided to allow a player to control a release of a blast of compressed air at locations adjacent to the play field which can influence the direction of game pieces.

In embodiments, a camera and display are provided to competitive amusement games that are linked together wherein the camera captures images of each player during play. The display may broadcast player images and or live action of players to other machines during play. When the game is completed and a winner has been determined, the image of the winning player is broadcast to each of the linked games and provided on a display. During play, different images and live action may be captured and broadcast to each of the linked games. For example, an image of the leader at any point in time may be broadcast, or an imager of the player that had the most recent score, or of the leading player associated with the current status of the leading players illuminated targets. When the game is over, the winner can be provided with a photograph as a prize or souvenir, in addition or in lieu of tickets or other prizes.

DETAILED DESCRIPTION

Figure 1:
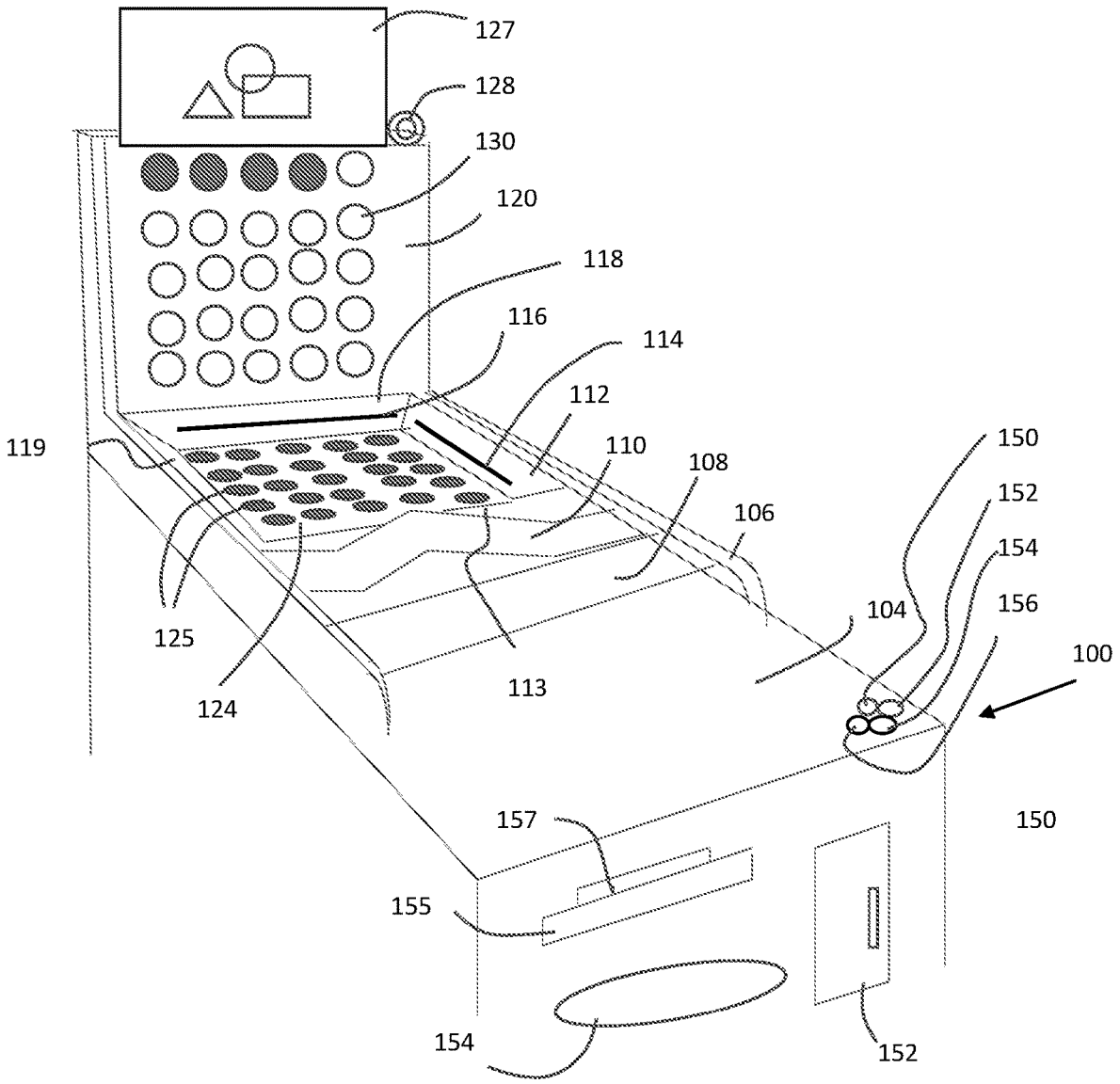
FIG. 1 is a perspective view of a first embodiment according to the invention.

Now referring to FIG. 1, the embodiment of the invention is a modified. Fascination game 100 that includes a play surface 104 on which a player can roll game balls over the incline 110 and toward target area 124 that includes 25 targets including targets 125. The targets are round holes provided through surface 124 and are sized larger than the balls so that balls can pass through the targets and fall into a retainer area. Target area 124 is surrounded by inclined surfaces 118, 112, 119 and 113 that cause balls that do not fall into targets to roll back into the target area. Shown in the inclined surface are slot openings in which are provided a series of exit ports that may release compressed air blasts in response to user input. The user may activate solenoids that control the release of compressed air with switches 150, 152, 154 and 156 that open a valve to release a blast of air which can affect the movement of balls that are rolling on the surface 124. This feature allows a player to direct balls toward desired targets and thereby provides players with increased control over the outcome of the game. Balls are provided to the at access area 154. In an embodiment a single ball is used and is returned to the player. The game is activated by a player providing a credit to activated device 152 which releases balls to the player at access area 154. As ball pass through the target openings they are detected by a detector and a corresponding light, such as light 130, is activated on progress display area 120. A second display 127 is provided above the progress and image display 120 which is an LED screen that is controlled by a central progressor. Second display 127 provides the status of progress of linked games so that a player can see the status of the targets on other player's games that have been hit and which targets need to be activated in order to win the game. Progress and image display 120 may also depict an image of the player adjacent to an image of the score display so each player is provided with information about the status of each player and to see if any single player is close to completing hitting five targets in a row during play. Images of the player are captured with camera 128 that is directed to the player location at the opposite end of the device. When the game is over, an award is provided to the winning player. The award may be in the form of credits, cash, or tickets from dispenser 157. In an embodiment, a printout of a photograph of the winner player is also distributed using printer 155.

Figure 2:
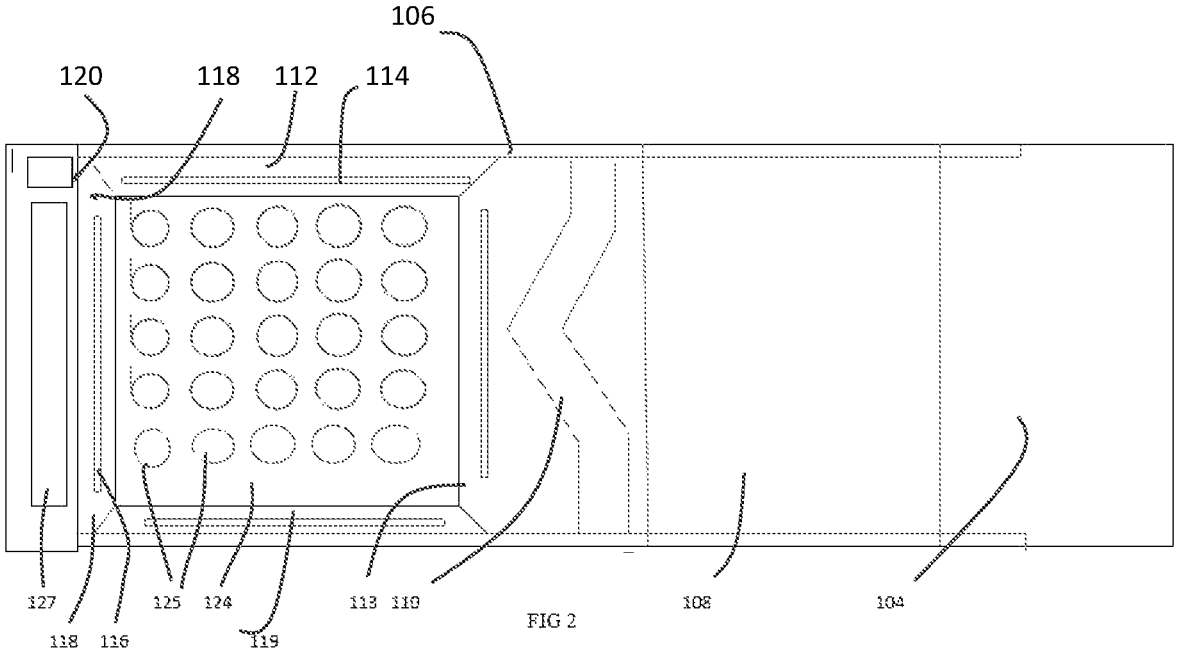
FIG. 2 is a top plan view of the embodiment of FIG. 1.

FIG. 2 is a top view of the embodiment of FIG. 1. The game includes a play field area 124 through which are a series of holes, such as holes 175, arranged in a five by five grid. At the rear of the game there is a first display 120 which tracks and displays the holes that have been successfully hit and a dynamic display board 127, comprised of a LED monitor, that can display scores and images from other linked games, images of game play, game directions and instructions. The game is played by rolling a ball down inclined surface 104, over elevated hump section 110 and into the play field. The ball is maintained in the play field 124 by inclined surfaces 118, 119, 112, and 113, that surround the play field. The player can control the balls on the play field by the timed release of air from portals that are provided through the inclined surfaces, such as portal 114, which can cause a ball on the surface 124 to move. After the ball is released by a player, transparent shield 108 prevents a player from interfering with the ball after release. Rail 106 keeps the balls in play. The nozzle switch activators are not shown.

Figure 3:
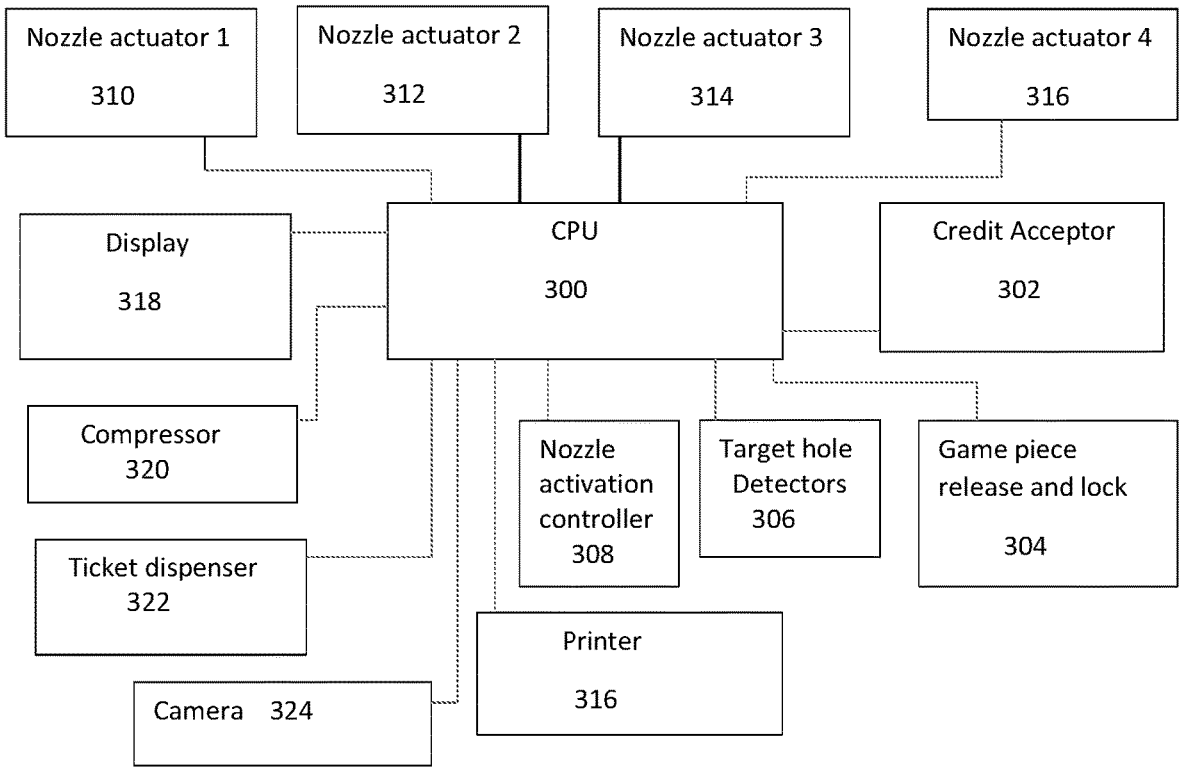
FIG. 3 is a schematic illustration of components of the invention according to the first embodiment of the invention.

Referring now to FIG. 3, components of the invention include a central processing unit 300 which receives input and provides output to various components of the game. The game is activated by the credit acceptor 302 which may be in the form of a credit card or electromagnetic card reader, a dollar bill acceptor, or coin or token detector. If a credit is detected, a credit switch is activated and, in response to the activation of the switch, game pieces, such as balls are released to the player at an access location using a game piece lock and release device 304. Device 304 may be a gate controlled by a solenoid or motor and restricts access to the game pieces. The player is then free to roll or propel the game pieces toward the targets. In the embodiment of FIG. 1, balls are rolled down toward the target field in other embodiments, the balls may be propelled by use of a plunger or powered by a solenoid. Four nozzle actuators, 310, 312, 314 and 316 are provided each of which is located on the four sides of the play field. A player can individually control each of the actuators by manipulation of the nozzle activation controller 308 that includes four switches, each which is connected and controls a separate actuator. Also connected to the central controller 300 is a compressor 320, that provides compressed air to the nozzles. Central controller 300 also controls display 318, a camera 324 and a ticket dispenser 322. Here, the score display and the dynamic display are schematically illustrated as a single display 318, and in embodiments, a single display may serve both functions. A printer 316 is provided so that images taken by the camera can be printed and provided to winning players. The controller or central processor 300 is also in communication with target hole detector 306. When the game is activated, balls are released by game piece releaser and lock 304 which consists of a solenoid-controlled gate.

Figure 4:
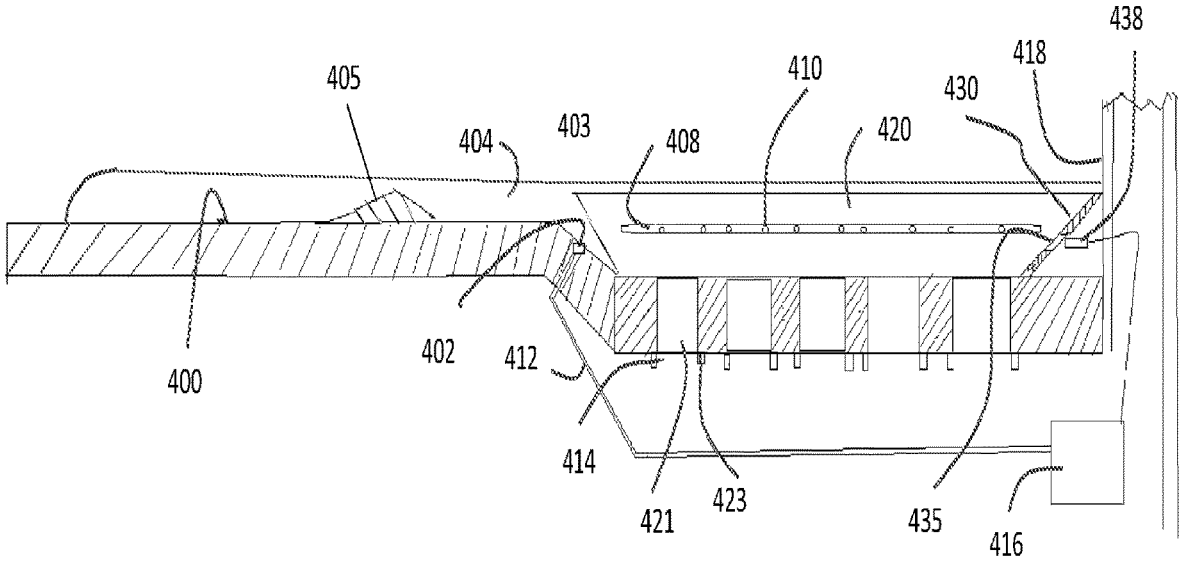
FIG. 4 is a side sectional view of the first embodiment of the invention.

FIG. 4 is a side sectional view of the embodiment of FIG. 1. This figure shows inclined ramp surface 400 and hump 405 over which balls are rolled toward the play field surface. On the four sides of the play field are inclined surfaces such as surface 420 and 430. Depicted in this view as can be seen within portal 408 are a series of nozzles, such as nozzle 410. In this embodiment the release of gas from all of the nozzles in a portal are activated by a single switch. In contemplated alternative embodiments, the release of gas from each nozzle may be activated by a separate switch. When a ball falls through an opening, such as opening 421, it is detected by a sensor that includes light source 414 and light detector 423. A signal from the detector 423 is sent to the central controller and, in response, an indicator light that corresponds to the opening is illuminated. This depiction also shows an air compressor 416 and an air supply hose 412 that directs compressed air to the nozzle 401 that is provided in a portal. through the front inclined surface and a nozzle 438 that is provided through portal 435 that is provided through rear inclined surface 430.

It will be clear to one skilled in the art that the embodiments described above can be altered in many ways without departing from the scope of the invention. Accordingly, the scope of the invention should be determined by the following claims and their legal equivalents.

The invention claimed is:

1. An arcade game comprising:

an elevated alley, said alley having a first planar section to receive rolling game elements, and a second alley section comprising targets, wherein said second alley section is substantially level, wherein when a rolling element is introduced to said game it may roll from said first alley section to said second alley section, and said targets further comprising passages through said second alley section that are sized to allow said rolling elements to pass through said passages, and each said target further comprising a sensor configured to detect when a rolling element passes through said passage, and a device to compress gas and a compressed gas reservoir, and a passage from said compressed gas reservoir to at least one compressed gas release valve, and a nozzle, said nozzle located in proximity to said second alley section and positioned to release compressed gas so as to affect rolling elements on said second alley section, and a compressed gas control switch for controlling the release of compressed gas through said compressed gas release valve, said arcade game further comprising a credit detector, a credit switch, a central controller and a display, wherein in response to the detection of a predetermined credit, said controller will activate said credit switch, and upon activation of said credit switch said central controller activates said compressed gas control switch, receives input from said target sensors and provides an output to said compressed air release valve and said display, and wherein said display provides information from said target sensors.

2. The arcade game recited in claim 1 further comprising a plurality of input switches for controlling the release of compressed gas and a plurality of compressed gas release valves and nozzles, each said switch corresponding to one of each said compressed gas released valves for the introduction of blasts of compressed gas through nozzlel at or near said second alley section.

3. The arcade game of claim 2 further comprising a camera, said camera oriented to capture an image of a player adjacent to said first alley section.

4. The arcade game as recited in claim 3 wherein said image from said camera is provided on said display.

5. The arcade game recited in claim 3 further comprising a printer wherein one or more selected images captured from said camera may be directed to said printer for reproduction.

6. A game system comprising a plurality of connected arcade games units as recited in claim 1, each said game unit connected to a second controller, wherein said second controller is configured to simultaneously activate a plurality of games and is provided information from each connected game's target sensors, and said controller is configured to detect the first game that has activated a predetermined set of target sensors.

7. The game system of claim 6 wherein said predetermined set of targets are oriented in a line comprising at least four targets.

8. The game system of claim 6 further comprising a central display, wherein said game display provides information relating to the targets that have been activated for each game in said system.

9. The game system of claim 6 further comprising a camera, said camera oriented to capture images in proximity to said first alley section and display said images on said central display.

10. The game system of claim 6 wherein said targets are configured in a grid arrangement.

* * * * *